United States Patent [19]

Booth

[11] 4,287,419

[45] Sep. 1, 1981

[54] STRONG FOCUS SPACE CHARGE

[75] Inventor: Rex Booth, Livermore, Calif.

[73] Assignee: The United States of America as represented by the United States Department of Energy, Washington, D.C.

[21] Appl. No.: 908,030

[22] Filed: May 22, 1978

[51] Int. Cl.[3] ..... G21K 1/00

[52] U.S. Cl. ..... 250/396 ML; 315/31 R

[58] Field of Search ..... 250/396 ML; 315/31 R

[56] References Cited

U.S. PATENT DOCUMENTS

| | | | |
|---|---|---|---|
| 2,919,381 | 12/1959 | Glaser | 315/31 R |
| 3,307,065 | 2/1967 | Arnaud et al. | 315/31 R |
| 3,319,110 | 5/1967 | Schlesinger | 315/31 R |
| 4,019,989 | 4/1977 | Hazewindus | 250/386 ML |

OTHER PUBLICATIONS

"Achromatic Quadrupole Electron Lenses" by Kellman et al., Soviet Physics: Technical Physics, vol. 6, No. 12, Jun. 1967, pp. 1052–1054.

*Primary Examiner*—Harold A. Dixon

*Attorney, Agent, or Firm*—L. E. Carnahan; Roger S. Gaither; James E. Denny

[57] ABSTRACT

Strong focus space charge lens wherein a combination of current-carrying coils and charged electrodes form crossed magnetic and electric fields to focus charged particle beams.

10 Claims, 3 Drawing Figures

STRONG FOCUS SPACE CHARGE

BACKGROUND OF THE INVENTION

The invention described herein was made at the Lawrence Livermore Laboratory in the course of, or under, Contract No. W-7405-ENG-48, between the United States Department of Energy and the University of California.

The invention relates to lenses for focusing charged particle beams, and more particularly to strong focus space charge lenses for focusing such beams.

When positive ion beams with high current density are transported, one relies on electrical neutralization of the beam by low energy electrons to keep it from expanding under the influence of its own space charge. Since the electrons which neutralize the beam can be easily removed by electric fields, electrostatic lenses are usually avoided. The space charge or plasma lens, however, which has been extensively studied in the Soviet Union, but which seems to have been largely overlooked elsewhere, simply redistributes the neutralizing electrons in an optically useful way.

The use of axially symmetric space charge distributions for focusing charged particles was discussed by Borries and Ruska in 1932 (see Z. Physik, 76, 649, 1932), and by D. Gabor in 1947 (see Nature, 160, 89, 1947). In 1964, Morozov (see Dokl. Akad. Nauk SSR, 163, 1363, 1965 and Sov. Phys. Doklady, 10, 775, 1966) analyzed the problem from a point of view of plasma physics, where he showed that an electric field can exist in a low density plasma without large currents only if a magnetic field and electron drift are present together; and where he pointed out that closed circuit drift paths become possible with crossed electric and magnetic fields, and that trapping of electrons reconfigures the electric field until the crossed field condition is achieved. Also, when the fields have become crossed, the magnetic field lines have become electric equipotentials.

In 1965, Lebedev and Morozov (see Zh. Tekh. Fiz., 36, 960, 1966, and Sov. Phys. Tech. Phys., 11, 707, 1966) analyzed the redistribution of neutralizing electrons for the case of a positive ion beam traversing a charged, current carrying ring electrode. They showed that the resulting electric field has focusing properties, and that the focusing field becomes independent of beam intensity. They suggested that both converging and diverging lenses might be made in this way since the focal length depends on the first power of lens voltage rather than on its square, and showed that this was a strong focus lens in comparison to either axial magnetic or electrostatic lenses.

In 1969, Zhukov, Morozov, and Shehepkin (see ZHETF Pis. Red., 9, 24, 1969 and JETP Lett. 9, 14, 1969) reported the successful operation of such a lens for beam currents between 0.5 and 15 mA. They showed that for Ar and He ions with energies between 3 and 8 keV, that the measured focal length (f) agreed quantitatively with the following simple expression:

$$f=(\phi)/(2U)\ (R)/(\theta)$$

where U is the lens voltage, $\phi$ is the particle accelerating potential difference, R is the radius of the ring electrode, and $\theta$ is a parameter of order one whose value depends on geometrical details of the lens. Note that neither ion mass nor ion charge appears in the above equation.

In later papers Lebedev and Morozov reported on analysis of the boundary conditions necessary to eliminate spherical aberration (see Zh Tekh. Fiz., 44, 1547, 1974 and Sov. Phys. Tech. Phys., 19, 966, 1975); on the design of achromatic lens pavis (see Zh. Tekh. Fiz., 44, 1548, 1974, and Sov. Phys. Tech. Phys., 19, 967, 1974); and on a prescription for correcting the lens fields to compensate for the effect of electron temperature with a lens (see Zh. Tekh. Fiz., 46, 1571, 1976, and Sov. Phys. Tech. Phys., 21, 903, 1976).

Standard lenses for charged particles include the solenoid and the quadrapole lens. A need exists for an alternative to these standard lenses which includes simpler construction, smaller physical size, lower power requirements, and the possibility of nonlinear design and operation. As pointed out above, the efforts in the Soviet Union on space charge or plasma lenses which constitute a strong focus lens in comparison to either axial magnetic or electrostatic lenses provides an advance over the standard lenses mentioned above, but do not fill the above identified alternative need.

SUMMARY OF THE INVENTION

The present invention is a strong focus space charge lens, which fulfills the above-mentioned needs by providing an alternative to the standard lenses. The advantages provided by the present invention include simpler construction, smaller physical size, and lower power requirements than the above-referenced standard lenses for charged particles, while also having the potential of nonlinear design and operation. The strong focus space charge lens of the present invention utilizes the combination of current-carrying coils and charged electrodes which form crossed magnetic and electric fields to focus charged particle beams.

Therefore, it is an object of this invention to provide space charge lenses for high current charged particle beams.

A further object of the invention is to provide a strong focus space charge lens.

Another object of the invention is to provide a lens for focusing charged particle beams by crossed magnetic and electric fields.

Another object of the invention is to provide strong focus space charge lenses which utilize a combination of current-carrying coils and charged electrodes to focus charged particle beams.

DETAILED DESCRIPTION OF CONTEMPLATED INVENTION

The invention combines current-carrying coils and charged electrodes which form crossed magnetic and electric fields defining a strong focus space charge lens to focus charged particle beams. The lens utilizes one simple coil associated with various electrostatic electrodes which uses less power than a grouping of several coils with relatively strong magnetic fields. Further, the electrostatic electrodes can serve as extraction grids for an ion source. Thus, the advantages offered by the present invention include simpler construction, smaller physical size, lower power requirements, and the possibility of nonlinear design and operation.

Figure 1:
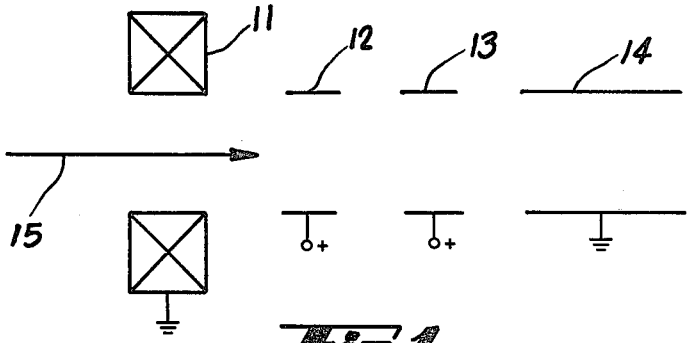
FIGS. 1–3 schematically illustrate embodiments of the strong focus space charge lens made in accordance with the invention.

The FIG. 1 illustrates a cylindrical lens embodiment of the invention wherein a coil 11 sets up a magnetic field, typically of one kilogauss, and ring or cylindrical electrodes 12, 13, and 14 create an electric field which is substantially at right angles to the magnetic field of the coil 11. The coil 11 and ring electrode 14 operate at zero potential, while electrodes 12 and 13 focus a positive ion beam indicated at 15 through a high positive potential (potential of 500 to voltage holding limit). Coil 11, for example, is a water-cooled, heat-conducting, epoxy-impregnated coil that can be operated to produce a vacuum magnetic field of 1.3 kG in the center with a 20 A coil current. The coil dimensions, for example, are 7 cm inside diameter, 20 cm outside diameter, and 5 cm in length. Electrodes 12, 13, and 14 are metal rings 8.4 cm inside diameter, with lengths of 3 cm, 2 cm, and 4 cm, respectively, constructed of brass or stainless steel, for example. The potentials applied to these electrodes are a few kilovolts (0.5 to voltage holding limit), the amount depending on the beam energy and focusing required.

Figure 2:
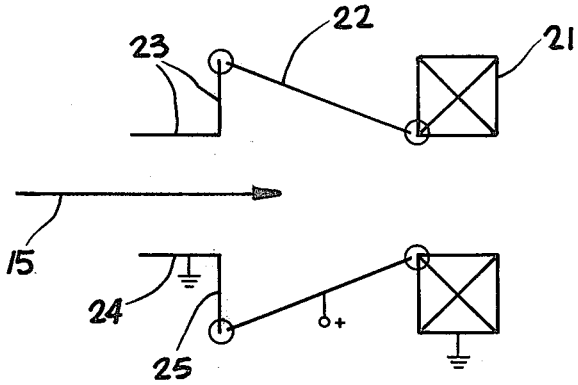

FIG. 2 illustrates a conical lens embodiment which consists of a coil 21, similar to coil 11 of the cylindrical embodiment of FIG. 1, and a pair of electrodes 22 and 23. Electrode 22 runs at a high positive potential (0.5 to voltage holding limit), while the coil 21 and electrode 23 are at zero potential. Electrode 22, for example, is a metallic cone, constructed of stainless steel, copper, or aluminum, of 12 cm length, 6.5 cm small diameter, and 14 cm large diameter. Electrode 23 includes a horizontal section 24 and a vertical section 25 and, for example, is constructed of stainless steel, copper, or aluminum, having a length of 5 cm, an inside diameter of 8.4 cm, and a 15 cm outside diameter face (outer edge of section 25), section 25 being located 0.3 cm from electrode 22. A charged particle beam 15 is focused as it passes through the lens.

Figure 3:
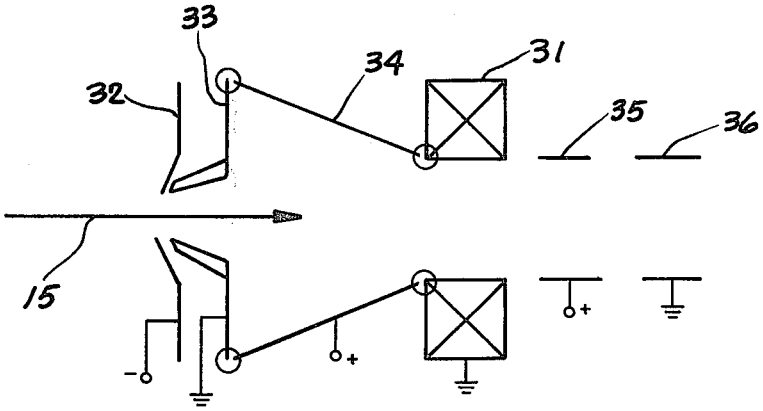

FIG. 3 illustrates an embodiment which combines portions of the cylindrical and conical lenses of FIG. 1 and FIG. 2. A coil 31, similar to that used in FIGS. 1 and 2, is located between the conical and the cylindrical section of the lens, with the conical section upstream of the cylindrical section as indicated by the direction of the charged particle beam 15. In addition, an ion source extractor system comprising an accel-decel pair of electrodes 32 and 33 is located upstream of and adjacent to a conical electrode 34, the electrode 34, for example, being similar to electrode 22 in FIG. 2. Electrode 32 is constructed, for example, of copper or molybdenum, and is at a high negative potential (5 kv to 0.20 kv), while electrode 33 is a grounded decel electrode, constructed of iron. The electrodes 32 and 33, for example, have an inside diameter tapering from 2.2 cm to 7.5 cm and 2.4 cm to 4 cm, respectively, a length of 1.0 and 5 cm, respectively, and an outer diameter of 14 cm, located 3.5 to 4.0 cm apart, with electrode 33 being spaced 0.3 to 0.5 cm from conical electrode 34. The cylindrical section consists of, besides coil 31, cylindrical electrodes 35 and 36 which are similar in construction to electrodes 12, 13, and 14 of FIG. 1, with inside diameters of 8.4 cm, and lengths of 3 cm and 4 cm, respectively. The coil 31 and electrode 36 are at ground potential while conical electrode 34 and cylindrical electrode 35 are raised to several kilovolts positive potential (0.5 to voltage holding limit).

In operation of the embodiments illustrated in FIGS. 1–3, electrons are trapped by the electric and magnetic fields of the lens, the electric field being at substantially right angles to the magnetic field, as pointed out above. The resulting discharge and plasma alter the electric field distribution inside the lens. The net electric field has strong radial components, much stronger than in an ordinary electrostatic lens. This electric field is strongly refractive with the refraction proportional to the incident positive ion's radius from the lens axis. Experiments show very good lens properties. The lens strength is proportional to the positive high voltage on the lens electrode. Also, the lens strength is inversely proportional to the ion energy.

The properties of the lenses of this invention can be varied. The lenses may be designed and operated such that no refraction occurs within a given radius of the lens axis. Outside this radius, refraction increases with the radius. The radius where the refraction starts can be controlled by the magnetic field strength, design of electrodes, and the positive high voltage used on the electrodes. The short cylinder lens section of FIG. 3 does not refract ions near the lens axis, but does deflect ions beyond a certain radius. Such lenses may be employed to correct ion beam path distortions produced by components in an ion accelerator. Also, neither the conical lens section nor the ion extractor of the FIG. 3 embodiment interfere with the other's function.

It is thus seen that the strong focus space charge lens of the present invention is simpler, smaller, and less power consuming than the older lenses utilized to focus charged particle beams. Also, the present invention has the added advantage that it can correct for ion ray distortions in accelerators. Thus, the lens of the present invention can replace solenoid and quadrapole lenses in low energy accelerators. While only one coil has been illustrated, it is within the scope of this invention to utilize more than one coil if desired.

While particular embodiments of the invention have been illustrated and described, modifications will become apparent to those skilled in the art, and it is intended to cover in the appended claims all modifications that come within the spirit and scope of the invention.

What I claim is:

1. A strong-focus space-charge lens for focusing charged-particle beams passing therethrough comprising: at least one current-carrying coil for creating a magnetic field, and a plurality of spaced charged electrodes positioned in spaced axial alignment with respect to said current-carrying coil for creating at least one electric field, said electric field being at substantially right angles to said magnetic field to form cross magnetic and electric fields to focus charged-particle beams; said plurality of spaced charged electrodes having an axial length greater than an axial length of said current-carrying coil; said coil and electrodes being constructed such that a charged-particle beam passing therethrough is focused thereby.

2. The lens defined in claim 1, wherein said plurality of charged electrodes comprises a plurality of cylindrically shaped electrodes.

3. A strong-focus space-charge lens for focusing charged-particle beams passing therethrough comprising: at least one current-carrying coil and a plurality of charged electrodes positioned in spaced axial alignment with respect to said current-carrying coil to form crossed magnetic and electric fields to focus charged particle beams; said plurality of charged electrodes consisting of three cylindrically shaped electrodes, each having a different length; said current-carrying coil and one of said three electrodes operating at zero electrical potential; and two of said electrodes operating at a positive electrical potential.

4. A strong-focus space-charge lens for focusing charged-particle beams passing therethrough comprising: at least one current-carrying coil and a plurality of charged electrodes positioned to form crossed magnetic and electric fields to focus charged particle beams, said plurality of charged electrodes comprising at least a pair of electrodes, one of said pair of electrodes having a conical configuration and located adjacent said current-carrying coil, and another of said pair of electrodes having substantially vertical and horizontal sections positioned at substantially right angles to each other with said vertical section being closely spaced with respect to said one of said pair of electrodes.

5. The lens defined in claim 4, wherein said conical configured electrode is positioned such that a smaller cross-section end thereof is adjacent said current-carrying coil and a larger cross-section end thereof is adjacent said another of said pair of electrodes.

6. The lens defined in claim 4, wherein said pair of electrodes are positioned upstream beamwise with respect to said current-carrying coil.

7. A strong-focus space-charge lens for focusing charged-particle beams passing therethrough comprising: at least one current-carrying coil and a plurality of charged electrodes positioned to form crossed magnetic and electric fields to focus charged-particle beams, said plurality of charged electrodes comprising at least a pair of cylindrically shaped electrodes and at least one conically shaped electrode.

8. The lens defined in claim 7, wherein said cylindrically shaped electrodes are located one side of said current-carrying coil, and wherein said conically shaped electrode is located on an opposite side of said coil.

9. The lens defined in claim 8, wherein said conically shaped electrode is located upstream beamwise from said current-carrying coil.

10. The lens defined in claim 9, additionally including an ion source extractor system comprising an accel-decel pair of electrodes located upstream beamwise with respect to said conically shaped electrode.

* * * * *

UNITED STATES PATENT AND TRADEMARK OFFICE

CERTIFICATE OF CORRECTION

PATENT NO. : 4,287,419

DATED : September 1, 1981

INVENTOR(S) : Rex Booth

It is certified that error appears in the above—identified patent and that said Letters Patent is hereby corrected as shown below:

Delete the Figure of drawing on the title page and substitute the attached sheet therefore.

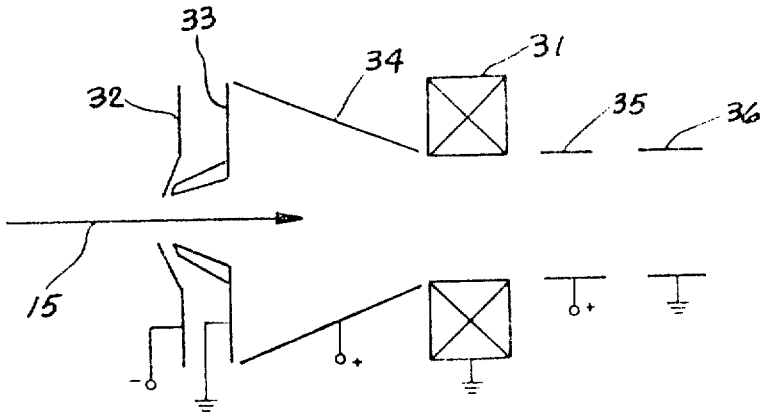

Signed and Sealed this

*Twenty-sixth* Day of *January 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,287,419

DATED : September 1, 1981

INVENTOR(S) : Rex Booth

It is certified that error appears in the above—identified patent and that said Letters Patent is hereby corrected as shown below:

Delete Figures 2 and 3 of the drawings and substitute the figures as shown below.

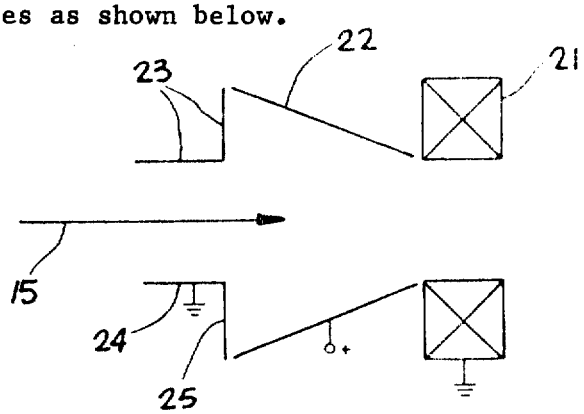

Fig. 2

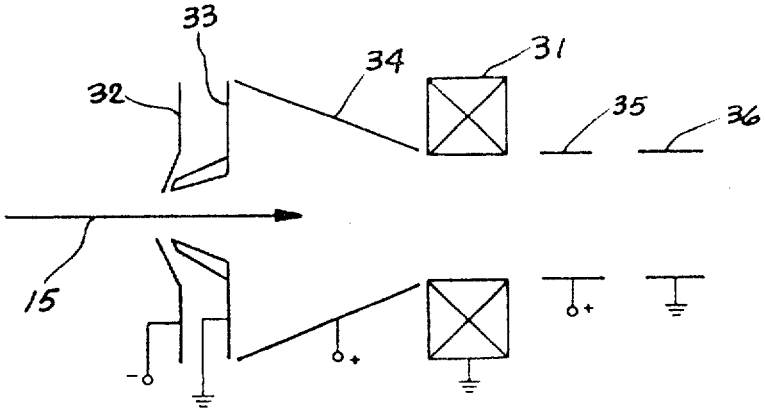

Fig. 3